US005521620A

United States Patent [19]

Becerra et al.

[11] Patent Number: 5,521,620

[45] Date of Patent: May 28, 1996

[54] CORRECTION CIRCUIT FOR AN INK JET DEVICE TO MAINTAIN PRINT QUALITY

[75] Inventors: Juan J. Becerra, Webster; Thomas E. Watrobski, Penfield, both of N.Y.

[73] Assignee: Xerox Corporation, Stamford, Conn.

[21] Appl. No.: 247,197

[22] Filed: May 20, 1994

[51] Int. Cl.[6] ..... B41J 29/38

[52] U.S. Cl. ..... 347/14; 347/57

[58] Field of Search ..... 347/14, 19, 57, 347/10, 11, 13

[56] References Cited

U.S. PATENT DOCUMENTS

| | | | |
|---|---|---|---|
| 4,463,359 | 7/1984 | Ayata et al. | 347/56 |
| 4,774,530 | 9/1988 | Hawkins | 347/63 |
| 4,872,028 | 10/1989 | Lloyd | 347/14 |
| 5,083,137 | 1/1992 | Badyal et al. | 347/14 |
| 5,160,403 | 11/1992 | Fisher et al. | 216/27 |
| 5,223,853 | 6/1993 | Wysocki et al. | 347/14 |

FOREIGN PATENT DOCUMENTS

| | | | |
|---|---|---|---|
| 4-339661 | 11/1992 | Japan | 347/14 |

*Primary Examiner*—Joseph W. Hartary
*Assistant Examiner*—Craig A. Hallacher
*Attorney, Agent, or Firm*—Oliff & Berridge

[57] ABSTRACT

A method and apparatus for maintaining a print quality of an ink jet apparatus comprises selecting one of a plurality of different pulse signals to apply to at least one heating element. The heating element is energized with the selected pulse signal. An actual voltage drop is then measured across the heating element. The actual voltage drop is subsequently compared with a desired voltage drop. Then, a new pulse signal is selected to energize the heating element based on the results of the comparison. The repetitive process continues until the actual voltage drop is substantially equal to the desired voltage drop. In another embodiment, a bubble sensor is used to determine whether a bubble has been formed over the heating element.

33 Claims, 11 Drawing Sheets

CORRECTION CIRCUIT FOR AN INK JET DEVICE TO MAINTAIN PRINT QUALITY

BACKGROUND OF THE INVENTION

1. Field of the Invention

This invention relates to thermal ink jet printers and, more particularly, to a method and apparatus for selecting pulse signals to be repeatedly applied to heating elements so as to maintain the print quality.

2. Description of Related Art

A thermal ink jet printhead selectively ejects droplets of ink from a plurality of drop ejectors to create a desired image on an image receiving member, such as paper. The printhead typically comprises an array of drop ejectors that convey ink to the image receiving member. In a carriage-type ink let printhead, the printhead moves back and forth relative to the image receiving member to print the image in swaths. Alternatively, the array may extend across the entire width of the image receiving member to form a full width printhead. Full width printheads remain stationary as the image receiving member moves in a direction substantially perpendicular to the array of drop ejectors.

The ink jet printhead typically comprises a plurality of ink passageways, such as capillary channels. Each channel has a nozzle end and is connected to an ink supply manifold. Ink from the manifold is retained within each channel until, in response to an appropriate signal applied to a resistive heating element in each channel, the ink in a potion of the channel adjacent to the heating element is rapidly heated and vaporized. Rapid vaporization of some of the ink in the channel creates a bubble that causes a quantity of ink (i.e., an ink droplet) to be ejected through the nozzle to the image receiving member. U.S. Pat. No. 4,774,530 to Hawkins, the disclosure of which is incorporated herein by reference, shows a general configuration of a typical ink jet printhead.

The reliable generation of bubbles by a heating element depends on the power per unit area generated by a heating element. When the voltage across the heating element is held constant, the power generated by a heating element decreases as the resistance of the heating element increases. The power generated by a heating element also decreases as the resistance of the driving transistor increases. Additionally, the power generated by a heating element decreases as the ambient temperature increases.

If the generated power is too low, then the heating element temperature may be insufficient to form bubbles in the nozzle. Therefore, the drops may or may not be generated by the nozzle. This could result in sporadic printing.

On the other hand, when the generated power is too high, although the heating element may form bubbles easily, the temperature of the heating element is elevated and the lifetime of the heating element is reduced. Accordingly, a high generated power reduces the longevity of the heating element.

Therefore, for at least the reasons set forth above, the power dissipated by a heating element is critical to uniform operation over time.

SUMMARY OF THE INVENTION

To solve these and other problems, this invention provides an apparatus and method for maintaining print quality by selecting one of a plurality of different pulse signals to be applied to each of a predetermined number of heating elements to produce a corresponding number of ink droplets. The apparatus comprises energizing means, measuring means, comparing means and converging means. The energizing means energizes each different predetermined number of heating elements with a corresponding different one of the plurality of different pulse signals. The measuring means measures an actual voltage drop across one of the predetermined number of heating elements as those heating elements are energized. The comparing means compares the actual voltage drop measured by the measuring means with a desired voltage drop. The comparing means generates a difference signal based on the difference between the actual voltage drop and the desired voltage drop. The converging means receives the difference signal from the comparing means and selects a new pulse signal. The energizing means subsequently energizes each of the predetermined number of heating elements with the new pulse signal. The converging means repeatedly selects among the plurality of different pulse signals based on the difference signal until the actual voltage drop is within a predetermined range of the desired voltage drop.

In another embodiment, pulsing means apply pulse signals to the heating element. Detecting means detect a condition in the vicinity of the heating element when the pulse signals are applied to the heating element. A circuit then selectively modifies the pulse signals applied to the heating element based on the detected condition. The detected condition can be an actual voltage drop across the heating element or a formation of a bubble over the heating element.

Other objects, advantages and salient features of the invention will become apparent from the following detailed description taken in conjunction with the annexed drawings, which disclose preferred embodiments of the invention.

BRIEF DESCRIPTION OF THE DRAWINGS

The invention will be described with reference to the following drawings in which like reference numerals refer to like elements and wherein.

DETAILED DESCRIPTION OF PREFERRED EMBODIMENTS

Figure 1:
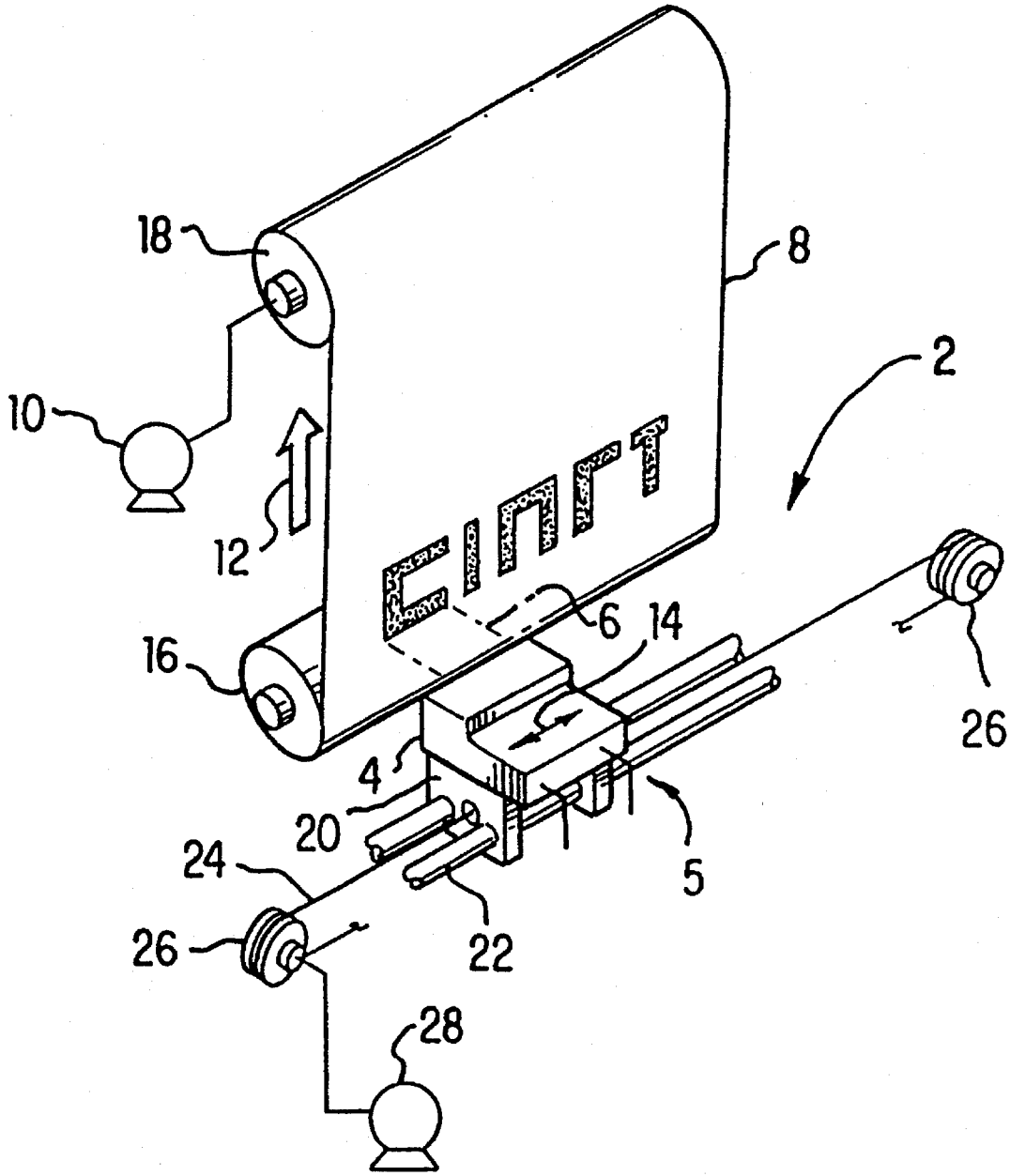
FIG. 1 is a schematic view of a prior art ink jet printing system.

FIG. 1 shows a typical carriage-type ink jet printing device 2. A linear array of droplet-producing channels is housed in the printhead 4 of reciprocal carriage assembly 5. Ink droplets 6 are propelled to a receiving medium 8 that is stepped by a motor 10 a preselected distance in the direction of arrow 12 each time the printhead 4 traverses across the receiving medium 8 in the directions indicated by arrow 14. The receiving medium 8, such as paper, can be stored on a supply roll 16 and stepped onto take-up roll 18 by stepper motor 10 or other means well known in the art.

The printhead 4 is fixedly mounted on the support base 20, which is adapted for reciprocal movement using any well known means, such as two parallel guide rails 22. The reciprocal movement of the printhead 4 may be achieved by a cable 24 and a pair of rotatable pulleys 26, one of which is powered by a reversible motor 28. The printhead 4 is generally moved across the receiving medium 8 perpendicularly to the direction the receiving medium 8 is moved by the motor 10. Of course, other structures for reciprocating the carriage assembly 5 are possible.

Alternatively, the linear array of droplet-producing channels may extend across the entire width of the receiving medium 8, as is well known in the art. This is typically referred to as a full-width array. See, for example, U.S. Pat. No. 5,160,403 to Fisher et al. and U.S. Pat. No. 4,463,359 to Ayata et al., the disclosures of which are incorporated herein by reference.

Figure 2:
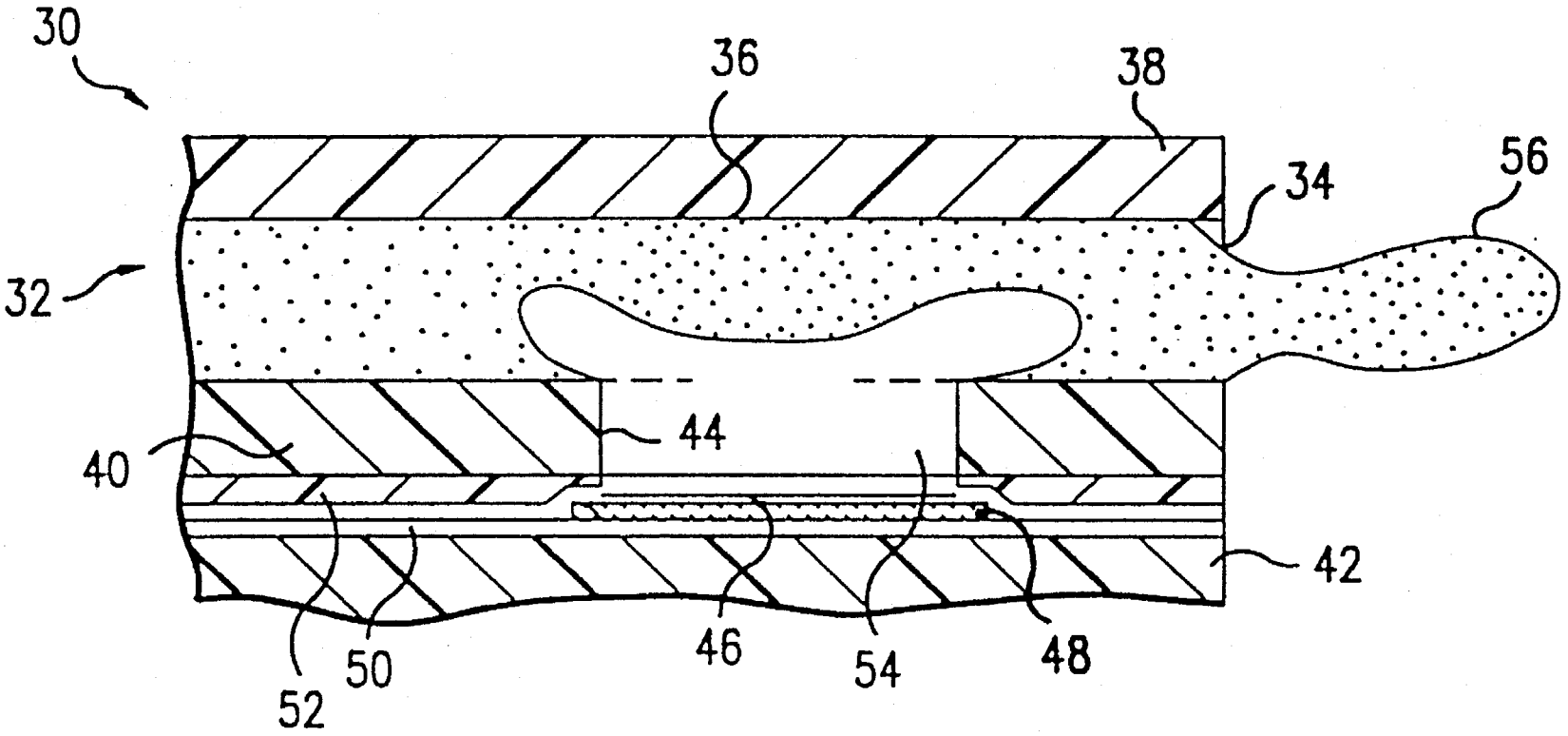
FIG. 2 is a cross-sectional view of a single ejector channel of one embodiment of an ink jet printhead.

FIG. 2 shows an ink droplet ejector of one embodiment of a typical ink jet printhead, one of a large plurality of such ejectors found in an ink jet printhead. While FIG. 2 shows a side-shooter ejector, other ejectors such as roof-shooter ejectors may similarly be used with the present invention. Typically, such ejectors are sized and arranged in linear arrays of 300–600 ejectors per inch. A member having a plurality of channels for ink droplet ejectors define therein is known as a "die module". For example, this member may be silicon. Each die module typically comprises 128 ejectors. Generally, a carriage-type printhead will have a single die module. An ink jet printhead may have one or more die modules forming the full-width array extending the full-width of the receiving medium on which the image is to be printed. In designs with multiple die modules, each die module may include its own ink supply manifold, or multiple die modules may share a common ink supply manifold.

Each ejector 30 includes a capillary channel 32 terminating in an orifice or nozzle 34. The channel 32 holds a quantity of ink 36 maintained within the capillary channel 32 until a droplet of ink is ejected. Each capillary channel is connected to a supply of ink from an ink supply manifold (not shown). In the ejector shown in FIG. 2, the main portion of channel 32 is defined by a groove anisotropically etched into an upper substrate 38, which is made of crystalline: silicon. The upper substrate 38 abuts a thick-film layer 40, which in turn abuts a lower substrate 42.

Sandwiched between the thick film layer 40 and lower substrate 42 are electrical heating elements 46 for ejecting ink droplets from the capillary channel 32 in a well known manner. The heating element 46 is located within a recess 44 formed by an opening in the thick film layer 40. The heating element 46 is protected by a protective layer 48 made of, for example, tantalum having a thickness of about 1 micron. The heating element 46 is electrically connected to art addressing electrode 50. Each of the ejectors 30 in the printhead 4 has its own heating element 46 and individual addressing electrode 50. The addressing electrode 50 is protected by a passivation layer 52. Each addressing electrode 50 and heating element 46 is selectively controlled by control circuitry, as will be explained in detail below.

As is well known in the art, when a signal is applied to the addressing electrode 50, the heating element 46 is energized. The heat from the resistive heating element 46 causes the liquid ink immediately adjacent the heating element 46 to vaporize, creating a bubble 54 of vaporized ink. The force of the expanding bubble 54 ejects an ink droplet 56 from the orifice 34 onto the surface of the receiving medium 8.

Figure 3:
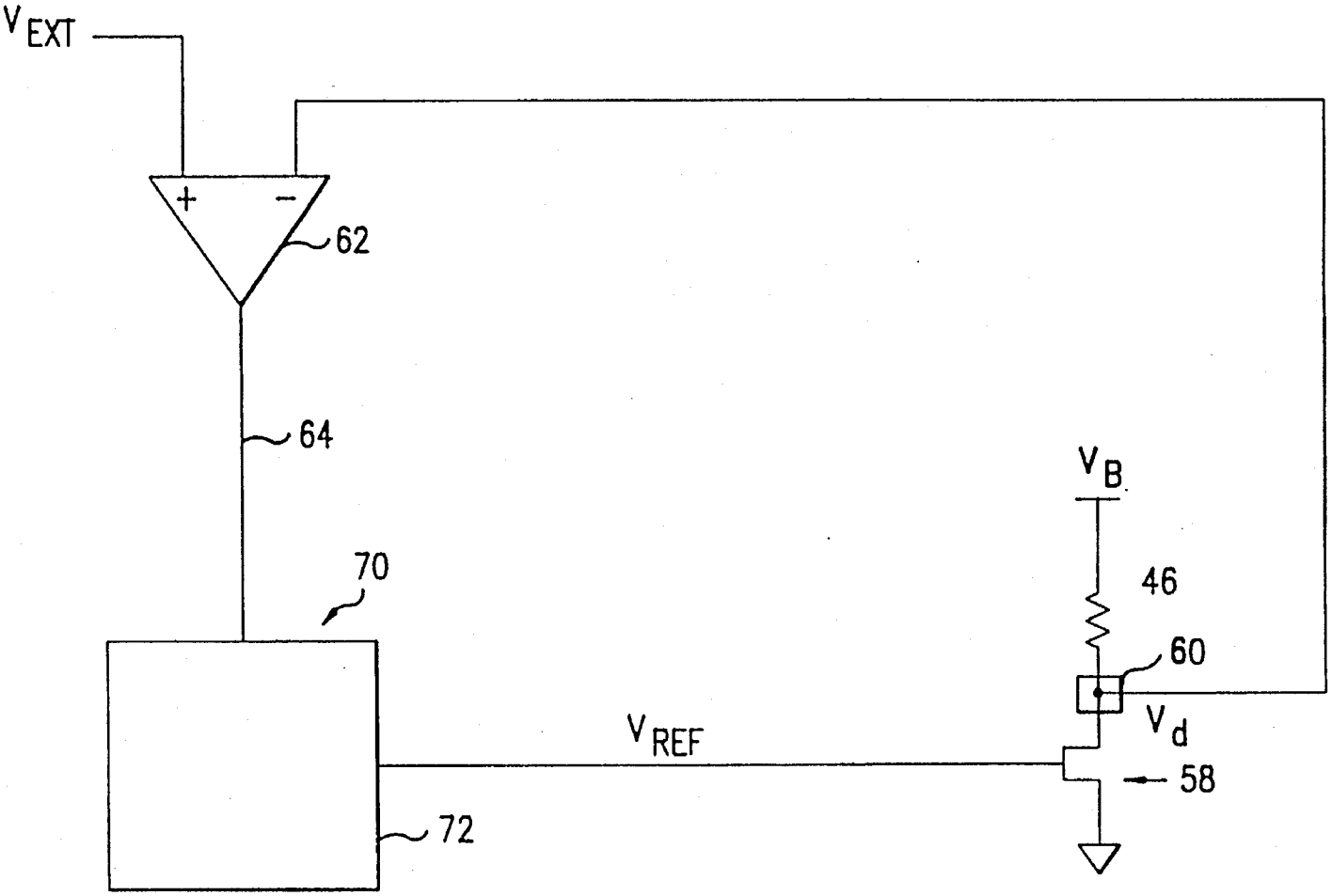
FIG. 3 is a schematic diagram of a correction circuit for use with the invention.

FIG. 3 shows a correction circuit for use with the present invention. The heating element 46 is connected between a constant voltage $V_B$ and the drain of a driving transistor 58. The source of the driving transistor 58 is connected to ground. A test pad 60 is positioned at a connection point between the heating element 46 and the driving transistor 58 to measure the voltage signal ($V_d$). The test pad 60 may include either a testing probe or other similar type of electrical connection device.

The voltage signal ($V_d$) on the test pad 60 is input to a terminal of the comparator 62. This voltage signal ($V_d$) is the actual drain voltage. The actual voltage drop across the heating element 46 is determined by subtracting the drain voltage $V_d$ from the constant voltage $V_B$. Based on prior use and the desired print quality, the desired voltage drop across the heating element is known. The present invention operates to adjust the drain voltage $V_d$ to thereby adjust the voltage drop across the heating element 46. To accomplish this, a desired drain voltage $V_{ext}$ is input to another terminal of the comparator 62. The desired drain voltage is computed by knowing the constant voltage $V_B$ and the desired voltage drop across the heating element 46. In the illustrated embodiment shown in FIG. 3, the voltage signal ($V_d$) is input to a negative terminal of the comparator 62 while the desired drawn voltage is input to a positive terminal of the comparator 62.

The comparator 62 compares the actual drain voltage ($V_d$) with the desired drain voltage ($V_{ext}$). Based on the voltage difference between $V_d$ and $V_{ext}$, a difference signal is output along line 64 to a converging circuit 70. The use and operation of the comparator 62 is well known to those skilled in the art.

The converging circuit 70 outputs one of a plurality of pulse signals ($V_{ref}$) along line 72 to the driving transistor 58. The converging circuit 70 receives the difference signal from the comparator 62 along line 64 and provides a pulse signal ($V_{ref}$) along line 72 to the gate of the driving transistor 58. The selected pulse signal is repeatedly output along line 72 to actuate the heating element 46 both on and off and, accordingly, eject ink droplets from the ejector 30. Thus, the embodiment shown in FIG. 3 provides a feedback loop to continuously compare the actual drain voltage $V_d$ with a desired drain voltage $V_{ext}$. Because the voltage drop across the heating element 46 is determined from the drain voltage, the comparator is also comparing the actual voltage drop with a desired voltage drop.

Figure 4:
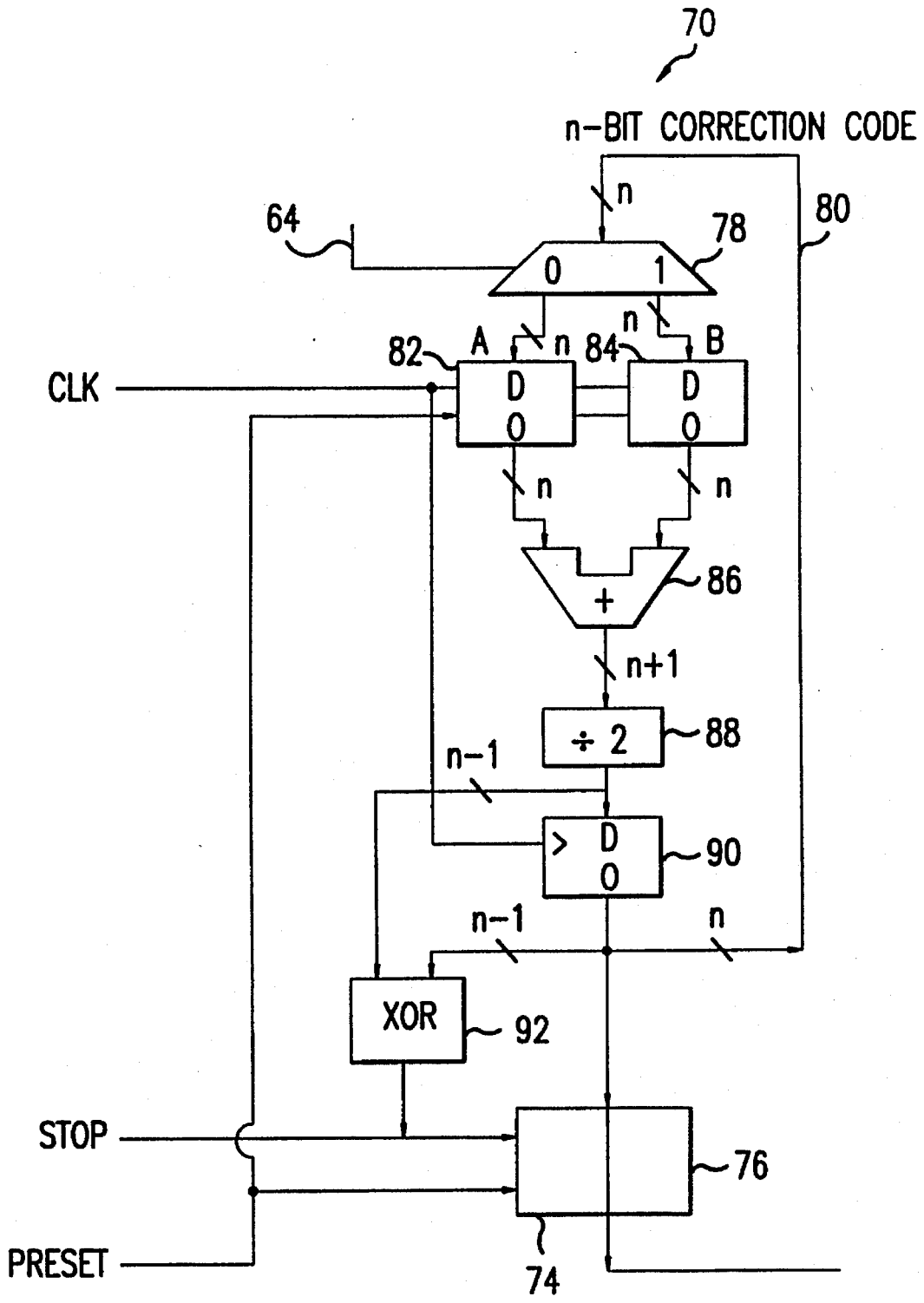
FIG. 4 is a schematic diagram of the converging block of FIG. 3 according to a first embodiment of the invention.

FIG. 4 shows a first embodiment of the converging circuit 70. The converging circuit 70 includes a memory device 74 used as a look-up table. The memory device 74 stores a digital code for each possible pulse signal applied over line 72 to the driving transistor 58. Each possible pulse signal is stored in a separate memory location represented by a different n-bit digital correction code. For example, the preferred embodiment of this invention uses a 5-bit correction code (such as 00000 to 11111), although a larger or smaller number of bits may be used for each correction code. Because 5 bits are used to represent each correction code, a total of 32 different pulse signals are stored in 32 different memory locations. In an n-bit correction code, a total of $2^n$ different pulse signals are used. Therefore, in the above example using a 5 bit correction code, the heating elements are energized by one of 32 different pulse signals.

In operation, the converging circuit 70 selects one of the different pulse signals from the memory device 74 and outputs the selected pulse signal. Each time a correction code is selected from the memory device 74, the selected digital pulse signal is converted into an analog pulse signal using the digital-to-analog converter 76. The analog pulse signal is then applied along line 72 to the driving transistor 58.

Figure 5:
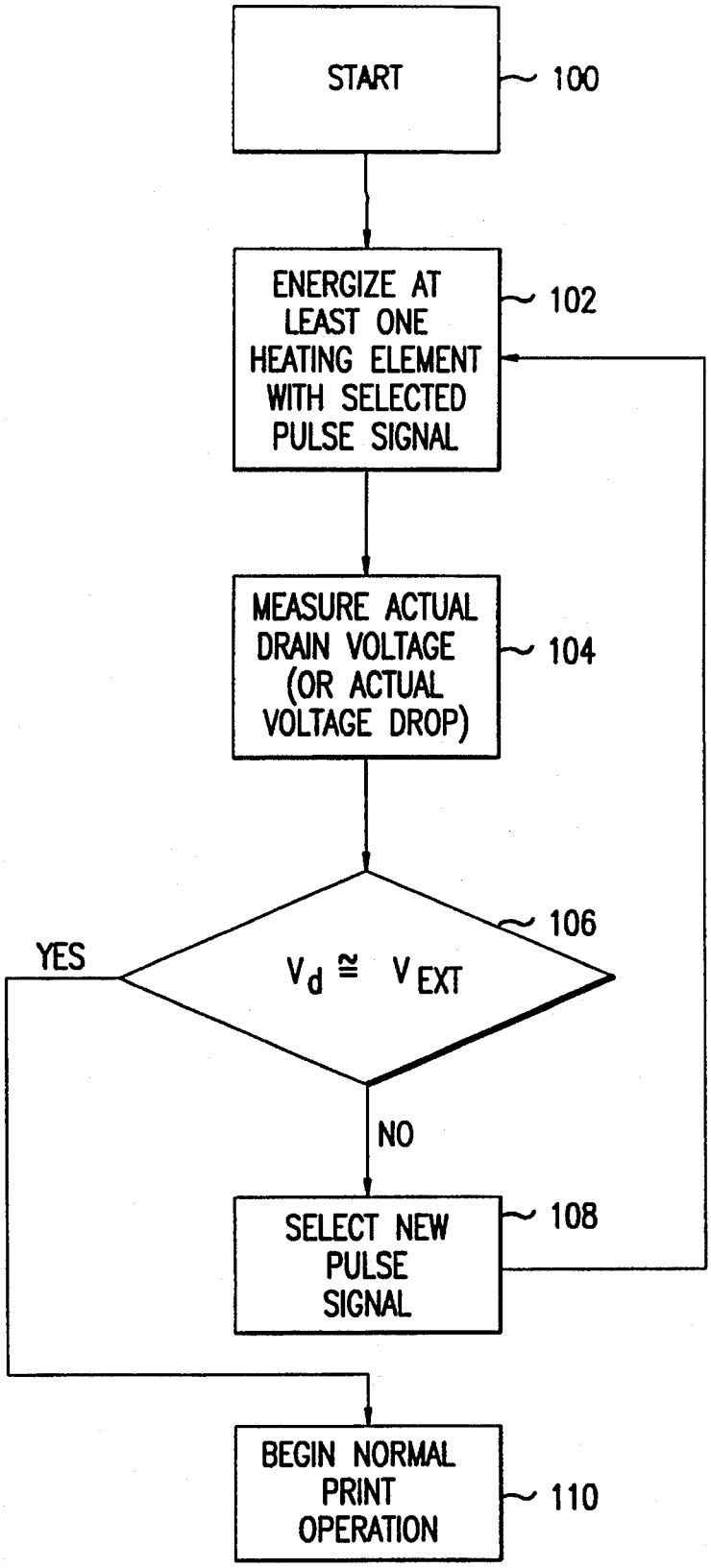
FIG. 5 is a flowchart showing a method of the invention.

The method and apparatus for selecting the appropriate pulse signal in the memory device 74 to produce a desired print quality are shown in FIGS. 4 and 5. As shown in FIG. 4, the difference signal output from the comparator 62 along line 64 is input to a demultiplexer 78. As previously explained, this difference signal represents the difference between the actual drain voltage ($V_d$) and the desired drain voltage ($V_{ext}$). This difference signal also represents the difference between the actual voltage drop and the desired voltage drop across the heating element 46. Based on the polarity of the difference signal, the demultiplexer 78 outputs an n-bit signal through either channel 0 (representing state A) or channel 1 (representing state B).

Channel 0 of the demultiplexer 78 is connected to a D flip-flop 82. The Q output of the flip-flop 82 is connected to a first input of the adder circuit 86. In a similar manner, channel 1 is connected to a D flip-flop 84. The Q output of the flip-flop 84 is connected to another input of the adder 86. The operation of the D flip-flops 82 and 84 are well known in the art. During each rising (or falling) edge of the clock pulse CLK, each of the respective flip-flops 82 and 84 inputs the value seen at its D input. Then, the current states stored in the flip-flops 82 and 84 are output from their Q outputs to the adder circuit 86. Therefore, only if the input of the D flip-flop is changed by the demultiplexer 78 before the rising (or falling) edge of the clock signal CLK will the output of the flip-flop change.

The adder 86 adds the two n-bit inputs from the flip-flops 82 and 84 and produces an n+1 bit added code. The divider 88 divides the n+1 bit code by 2 and outputs the resulting n-bit code to the D flip-flop 90 and the most significant n−1 bits of the resulting n-bit code to the XOR gate 92. The n-bit code output from the divider 88 is a current average correction code. The XOR gate 92 is connected to a stop signal line 94 and is used to stop the converging circuit 70 when the actual drain voltage is substantially equal to the desired drain voltage. The Q output of the flip-flop 90 is connected to the memory device 74 to store the resulting n-bit driving correction code. In this embodiment, the n-bit driving correction code is fed back to the input of the demultiplexer 78 from the D flip flop 90 along line 80.

The operation of the converging circuit 70 is shown in the flowchart of FIG. 5. The present invention is preferably used when the ink jet apparatus is first turned on so that an appropriate pulse signal can be selected to be repeatedly applied to the heating element 46 to produce a desired print quality. However, the present invention may also be used during a maintanance period in the normal operation of the ink jet apparatus. After the ink jet apparatus is first initialized in block 100, a preset pulse signal is used to actuate the driving transistor 58 and thus the heating element 46 in step 102. Additionally each of the flip-flops 82 and 84 are preset, respectively, to an initial ,upper bound and an initial lower bound.

In step 104, the actual drain voltage is measured at the test pad 60. This actual drain voltage corresponds to the voltage drop across the heating element 46 when the heating element 46 is actuated. The actual drain voltage $V_d$ is then compared in step 106 to the desired drain voltage $V_{ext}$ using the comparator 62. As described above, the demultiplexer 78 changes the correction code stored in one of the D flip-flops 82 and 84 based on the difference signal generated by the comparator 62. For the purposes of illustration, node A, shown in FIG. 4, corresponds to an upper bound of a desired correction code while node B corresponds to a lower bound of a desired correction code. Therefore, when the difference signal input along line 64 is a positive value indicating that the actual drain voltage is greater than the desired drain voltage, the lower bound stored in flip-flop 84 is changed to correspond to the driving correction code input to the demultiplexer 78 from the D flip-flop 90 along line 80.

The driving correction code input into the demultiplexer 78 corresponds to the correction code used to produce the pulse signal output along line 72 to actuate the heating element 46 during the previous cycle. Thus, the driving connection code may be referred to as a previous correction code. During each repetitive cycle, only one of the flip-flops 82 and 84 changes state. Therefore, only one of the upper and lower bounds changes during each clock pulse. In the above example, the flipflop 84 and thus the lower bound change while the upper bound and the flip-flop 82 remain the same. The new bound is stored into the flip-flop 84 during the rising (or falling) edge of the clock pulse CLK. During the rest of the clock pulse CLK, the upper and lower bounds stored on the flip-flops 82 and 84 are input to the adder 86 to add the two n-bit bounds to the correction codes. Subsequently, the divider 88 divides the added correction code by 2 to obtain a current average correction code that is an average of the current upper and current lower bounds just at the immediately preceding rising (or falling) edge of the clock pulse CLK.

The current average correction code is input to a first input of the XOR gate 92. As previously explained, the driving correction code is the Q output from the D flip-flop 90. The most significant n−1 bits of the driving correction code are also output to a second input of the XOR gate 92. In step 106, the XOR gate 92 compares the current average correction code with the driving correction code using a logic XOR function. In a preferred embodiment, only the n−1 uppermost bits of each code are compared in the XOR gate 92. When the XOR gate 92 determines that each of the n−1 bits of the current average correction code matches the corresponding bits of the driving correction code, then the XOR gate 92 outputs a stop signal to indicate that the actual drain voltage is substantially equal to the desired drain voltage. Another way to detect that the actual condition is substantially equal to the desired condition is to use iteration. Only a maximum of n cycles are needed for an n-bit code. For example, in a 5-bit code, only 5 iterations are needed. Therefore, after 5 iterations the cycle is stopped regardless of the result.

Upon each rising (or falling) edge of the clock pulse CLK, the current average correction code output from the divider 88 is input into the D flip-flop 90 to represent the new ,driving correction code. The new driving correction code is input back to the demultiplexer 78 along line 80, is input to the memory device 74 to select a new pulse signal, and is input to the XOR gate 92 to be compared with the current average correction code. The new driving correction code is used in step 108 to select a new pulse signal by locating the appropriate memory location in the memory device 74 as was previously described. If the XOR gate 92 does not generate a stop signal, then the method continues in step 102 to energize the heating element 46 with the new pulse signal. Thus, the apparatus continues the loop of steps 102, 104, 106 and 108 until a match is determined by the XOR gate 92.

Once the XOR gate 92 has determined that a match has been made, a stop signal is output along line 94 to stop the repetitive cycle involving steps 102, 104, 106 and 108 and to begin normal print operation in step 110. At this point, the selected pulse signal that produced the desired drain voltage is stored in memory device 74. This is the pulse signal stored in the memory device 74 at a location corresponding to the driving correction code. Therefore, in normal print operation, when it is desired to actuate the respective heating element 46, a pulse signal corresponding to the matched driving correction code stored in the memory device 74 is used to actuate the heating element 46. Accordingly, the print quality of the heating element 46 remains constant because the selected pulse signal produces a desired constant voltage drop. Additionally, by proceeding through a maintenance period after a fixed period of time, such as every month, the ink jet device may maintain the print quality by adjusting the pulse signals in a manner similar to that described above.

Figure 6:
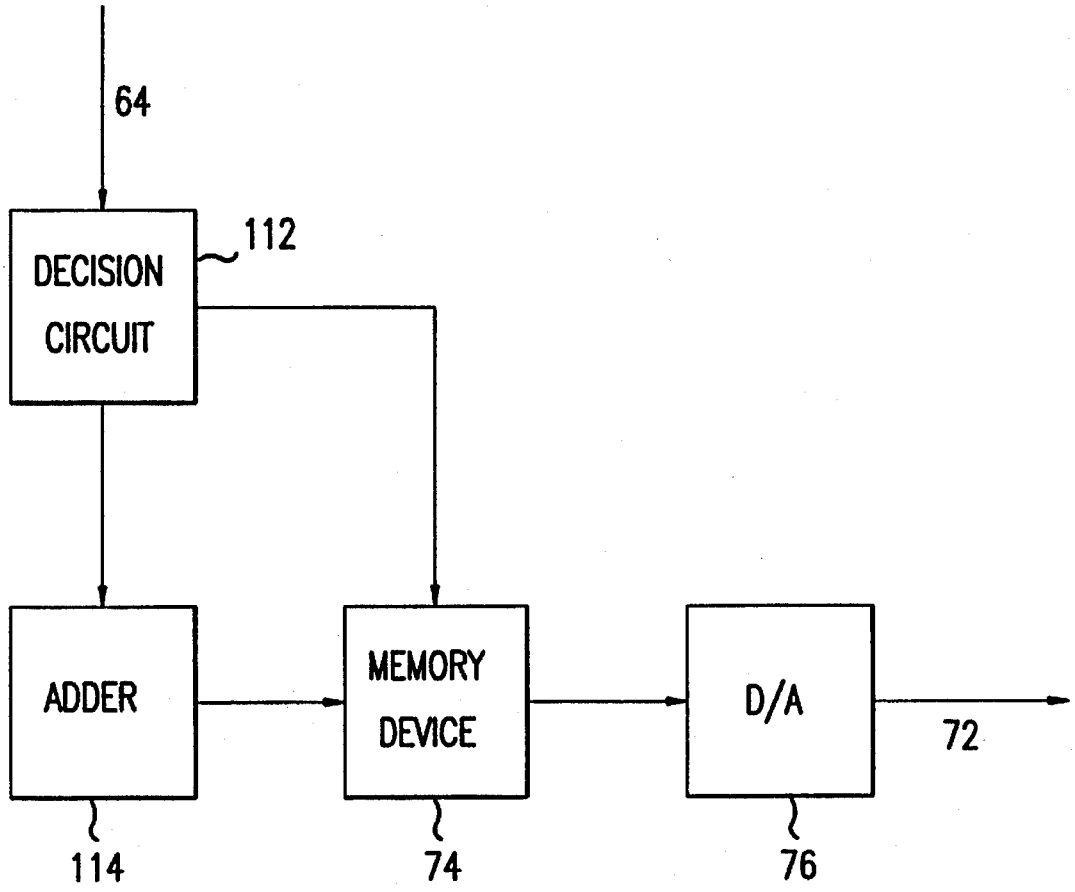
FIG. 6 is a schematic diagram of the converging block of FIG. 3 according to a second embodiment of the invention.

A second embodiment of the converging circuit 70 will now be described with respect to FIG. 6. The method corresponding to this embodiment is similar to that shown in FIG. 5. However, the process of step 108 is changed such that the converging circuit 70 sequentially steps through each of the correction codes by adding one bit to the previous correction code. Initially the correction code counter is set to 00000 for a 5-bit correction code. As shown in FIG. 6, the difference signal output from comparator 62 along line 64 is input to a decision circuit 112 that determines whether the actual drain voltage is sufficiently equal to the desired drain voltage based on the magnitude of the difference signal. The decision circuit 112 is connected to an adder circuit 114 that adds one bit (i.e., 00001) to the previous correction code.

The adder circuit 114 is connected to the memory device 74 that is used in a manner previously described. As in the first embodiment, the pulse signal in the memory device 74 corresponding to the inputted n-bit correction code is converted by the digital-to-analog converter 76 and output as a pulse signal along line 72 to the driving transistor 58. This cycle continues until the decision circuit 112 determines that the actual drain voltage is substantially equal to the desired drain voltage based on the difference signal when the decision circuit 112 determines that the actual drain voltage is substantially equal to the desired drain voltage. Then the previous correction code is the desired correction code needed to drive the heating element 46 and maintain a uniform print quality. However, if the decision circuit 112 determines that the actual drain voltage and the desired drain voltage are not substantially equal, then the adder circuit 114 adds one bit to the previous correction code. Therefore, the circuitry shown in FIG. 6 operates to continuously add a single bit to the previous correction code until the decision circuit 112 determines that the heating element 46 is energized to the desired level indicative of a desired print quality.

In the first embodiment, the upper and lower bounds are continuously updated so that the desired pulse signals output to the driving transistor 58 can be more quickly obtained. In the second embodiment, the circuitry steps through each of the respective correction codes until one is determined to produce an actual drain voltage substantially equal to the desired drain voltage.

As previously indicated, an ink jet printhead normally comprises a plurality of ejectors or channels. In a full-width application, these ejectors or channels are divided into a number of die modules. A die module normally comprises 128 ejectors. Each die module may be further subdivided into banks of heating elements. In an illustrative ink jet apparatus of this invention, each die module is subdivided into 32 banks of 4 heating elements each. For purposes of illustration, b will be used to represent the number of the bank on the die module. It is appreciated that other combinations on the number of heating elements for each bank can similarly be used. During each printing operation of the printhead 4, each die module selects either 1, 2, 3 or 4 of the heating elements of each bank to eject ink droplets. The decision to actuate 1–4 heating elements is performed by control circuitry (not shown) in a manner well known in the art. Each of the banks operates independently to eject a predetermined number of ink droplets.

It is a common problem in the prior art that when the number of actuating heating elements increases, the print quality decreases because each of the heating elements is not maintained at a uniform power per unit area as in a previous print operation. Therefore, it is desirable to maintain the power per unit area among the heating elements depending on the number of actuated heating elements in each bank. As previously indicated, the supply voltage required to print without degrading print quality increases as the number of heating elements simultaneously addressed in each bank increases. Therefore, it is desirable to obtain a different pulse signal ($V_{ref}$) for each bank depending on the number of heating elements 46 that will be actuated in that bank for each print operation.

Figure 7:
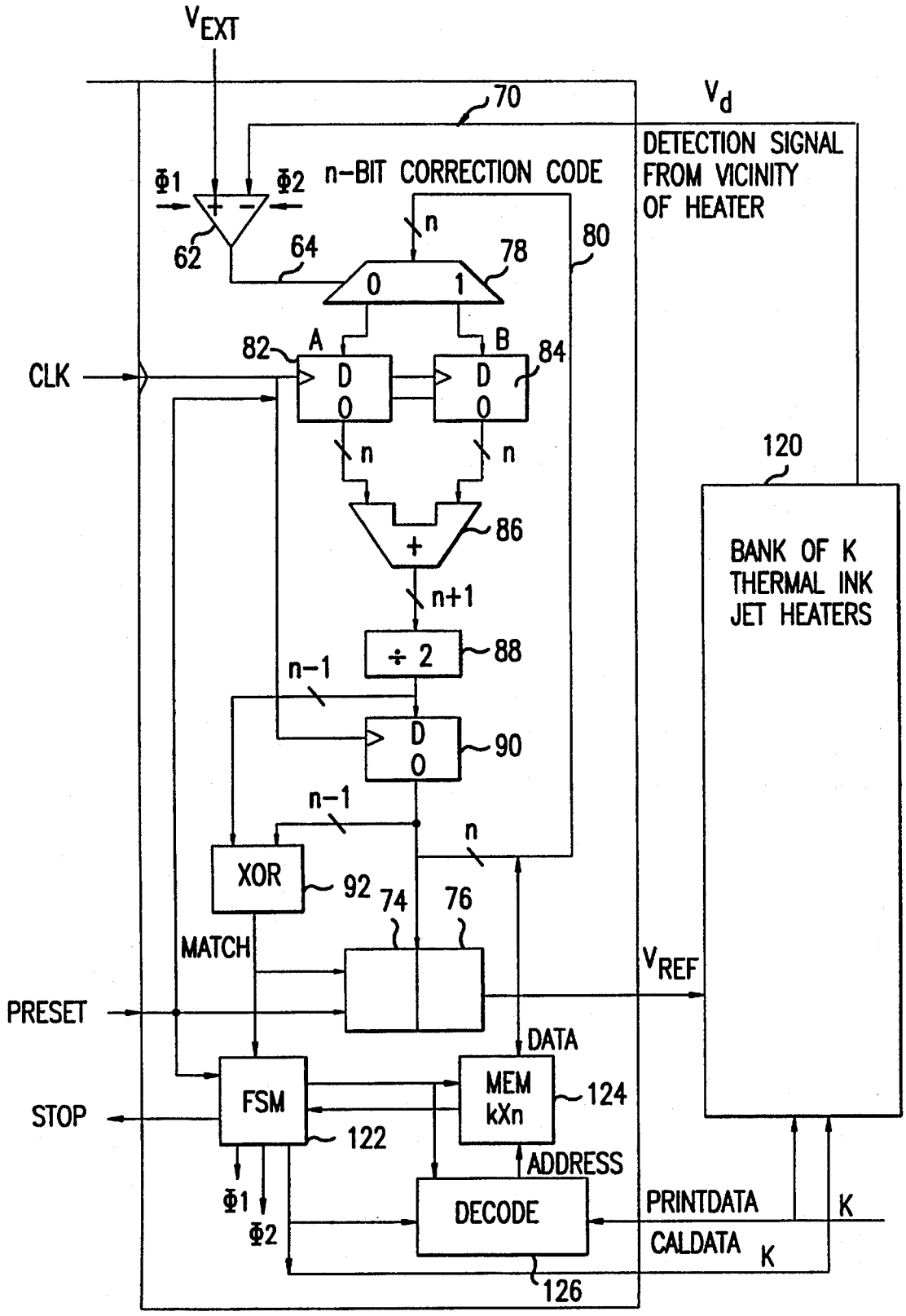
FIG. 7 is a schematic diagram showing a third embodiment of the invention.
Figure 8:
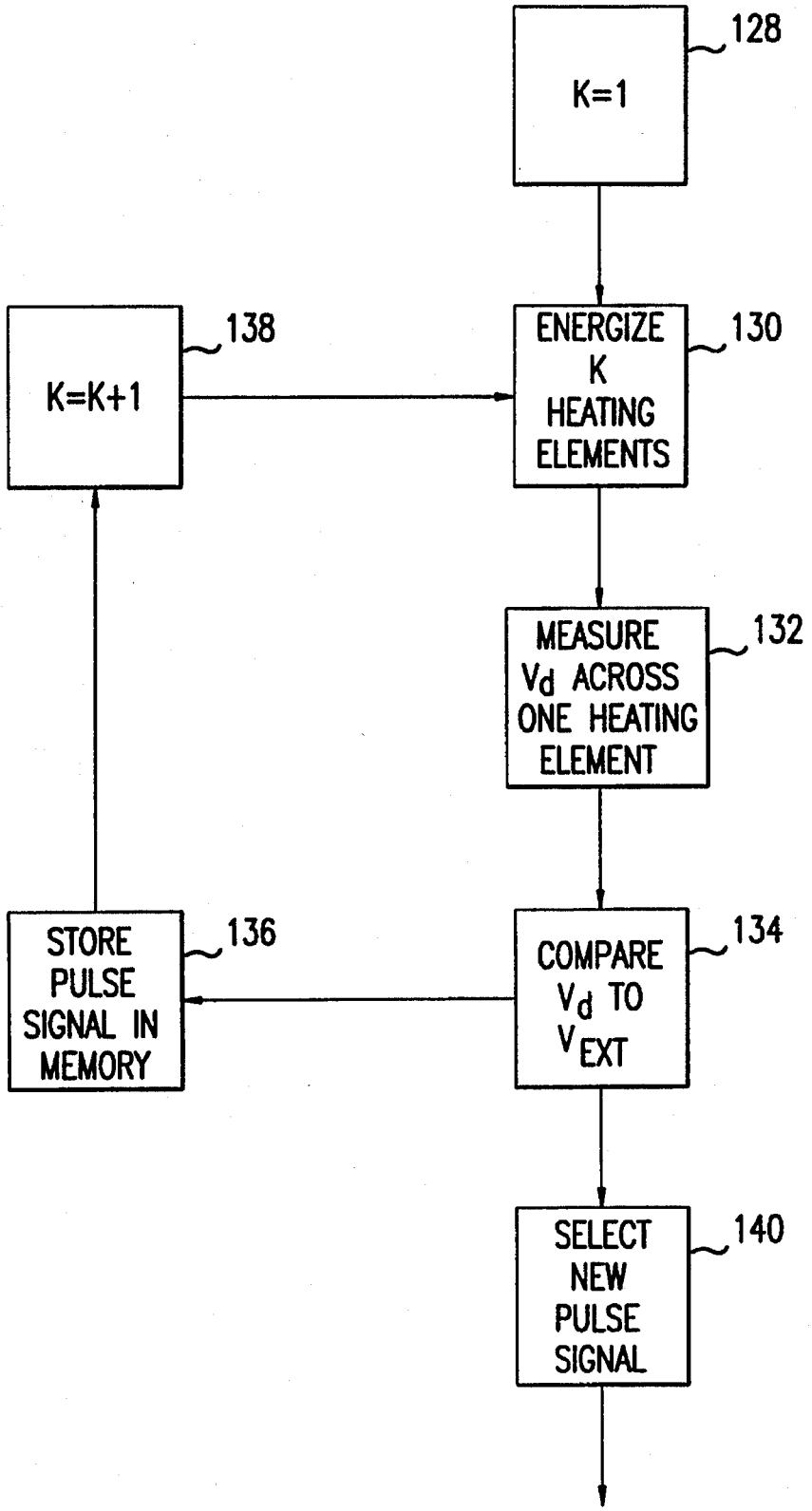
FIG. 8 is a flowchart showing a method for use with the third embodiment of the invention.

In a third embodiment of the present invention, an apparatus and method is provided for selecting a pulse signal to obtain a desired drain voltage depending on the number of actuated heating elements in a bank. While the third embodiment is described with respect to only one bank, the fourth embodiment is described with respect to a plurality of banks. As an alternative, the data of one respective bank from the third embodiment can be used to store data for each of the banks of the die module. The method and apparatus of the third embodiment can similarly be used in the fourth embodiment. FIG. 7 shows the apparatus used in the third embodiment, and FIG. 8 shows a method of using the apparatus. It will be appreciated by those skilled in the art that other modifications of this embodiment are within the scope of this invention.

FIG. 7 shows a bank 120 of k heating elements. Additional circuitry than that of FIG. 4 is provided in FIG. 7 to determine the pulse signal used to actuate the heating elements 46 in a bank 120 depending on the number of actuated heating elements. In particular, a finite state machine block 122 controls the sequence of calibration and control of the correction circuitry of the third embodiment. A memory device 124 is provided to store the pulse signals that produce the actual drain voltage substantially equal to the desired drain voltage depending on the number of actuated heating elements. Because k heating elements are provided in the bank 120, and each correction code is n-bits, then the memory device 124 must be a kxn size. A decode block 126 is also provided to receive data from the memory device 124 and to convert the digital codes into analog pulse signals. Based on the state of the finite state machine 122, the decode block 126 determines how many of the heating elements of that respective bank are to be energized, and then the decode block 126 applies the appropriate pulse signal to those heating elements. Therefore, the applied pulse signal will vary depending on how many of the heating elements in the bank 120 will be actuated.

The method of FIG. 8 will now be described with respect to the apparatus of FIG. 7. Initially, a number (k) of heating elements 46 to be tested to determine the appropriate pulse signal is set to 1 in step 128. Then, in similar manner to that of the method described with respect to FIG. 5, one heating element 46 is actuated in step 130. The actual drain voltage is measured across that one heating element in step 132. In the third embodiment, the initial desired drain voltage is initially set to $V_{ext}$ (as in the FIG. 4 embodiment). In step 134, the actual drain voltage is compared to the desired drain voltage. In similar manner to that described with respect to the first and second embodiments, a new pulse signal is selected in step 140. Steps 130, 132 and 134 are repeated in a manner similar to that described above until the actual drain voltage is substantially equal to the desired drain voltage. When the appropriate pulse signal is determined, the pulse signal producing the desired drain voltage is stored in step 136 in the memory device 124 at a location corresponding to the actuation of one heater element.

In step 138, the counter (k) is incremented by 1 to represent two actuating heating elements. In following the above example, two heating elements are actuated in step 130. Then in step 132, the actual drain voltage across one of the two heating elements is compared with the drain voltage when only one heating element is actuated. The drain voltage when only the one heating element is actuated was previously stored in the memory device 124 in the first iteration of steps 128, 130, 132 and 134. When two or more heating elements are simultaneously actuated, it is only necessary to measure one drain voltage because each of the heating elements will have a similar drain voltage drop.

The repetitive cycle of measuring the actual drain voltage in step 132, comparing the actual drain voltage with the desired drain voltage in step 134, and selecting a new pulse signal in step 140, continues in a manner similar to that of FIG. 4. When the XOR gate 92 determines that the appropriate pulse signal has been applied to the driving transistor 58, the respective pulse signal is stored in the memory device 124 at a location corresponding to two actuating heating elements. This process of continuously determining the pulse signal continues until a desired pulse signal is determined for the actuation of all k heating elements in the bank 120. Thus, the memory device 124 holds k pulse signals.

In the printing operation, control circuitry (not shown) determines how many heating elements in a bank will be actuated for each print. This determination is well known to those skilled in the art. Based on the number of heating elements in a bank desired to be actuated, the pulse signal digitally stored in the memory device 124 is output to the digital-to-analog converter in the decode block 126 so that each of the desired heating elements can be actuated with the pulse signal that produces an output drain voltage substantially equal to the desired drain voltage. Thus, the print quality of the ink jet apparatus is maintained at a uniform print quality regardless of the number of actuated heating elements for the bank.

As previously indicated, each bank comprises k heating elements. In the third embodiment, the desired pulse signal is selected depending on the number of actuated heating elements in a single bank. In a fourth embodiment to be described with reference to FIGS. 9 and 10, a method and apparatus is provided for performing the operation of the third embodiment for each bank (b) of the die module. For example, a die module may comprise 32 banks of 4 heating elements each. However, each of the banks of a die module may have a separate power per unit area depending on the location of the bank relative to the center of the die module. This can produce a "smile effect" because the center banks will have a lower power per unit area than the banks on the outside of the die module. Thus, the fourth embodiment is important for calibrating each of the banks separately.

Figure 9:
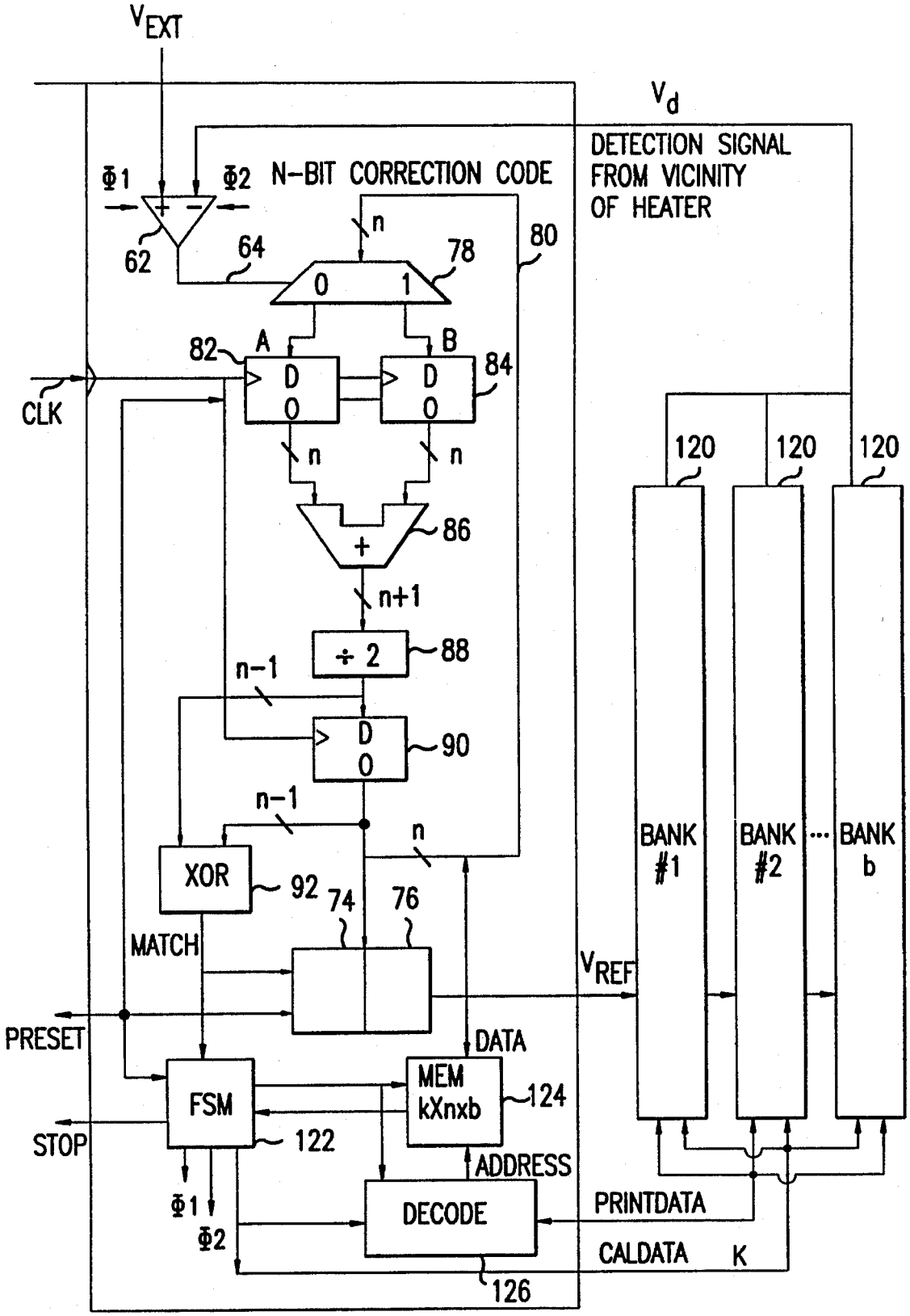
FIG. 9 is a schematic diagram showing a fourth embodiment of the invention.

FIG. 9 is similar to FIG. 7 except that a plurality of banks b are provided. In this embodiment, each bank b will be separately calibrated to determine the selected pulse signal depending on the number of actuated heating elements in each bank. Therefore, the memory device 124 stores k× n×b data bits representative of k×b selected reference voltages. The finite state machine 122 and the decode block 126 control the respective bank b being calibrated and the respective number of actuated heating elements k of the bank b.

Figure 10:
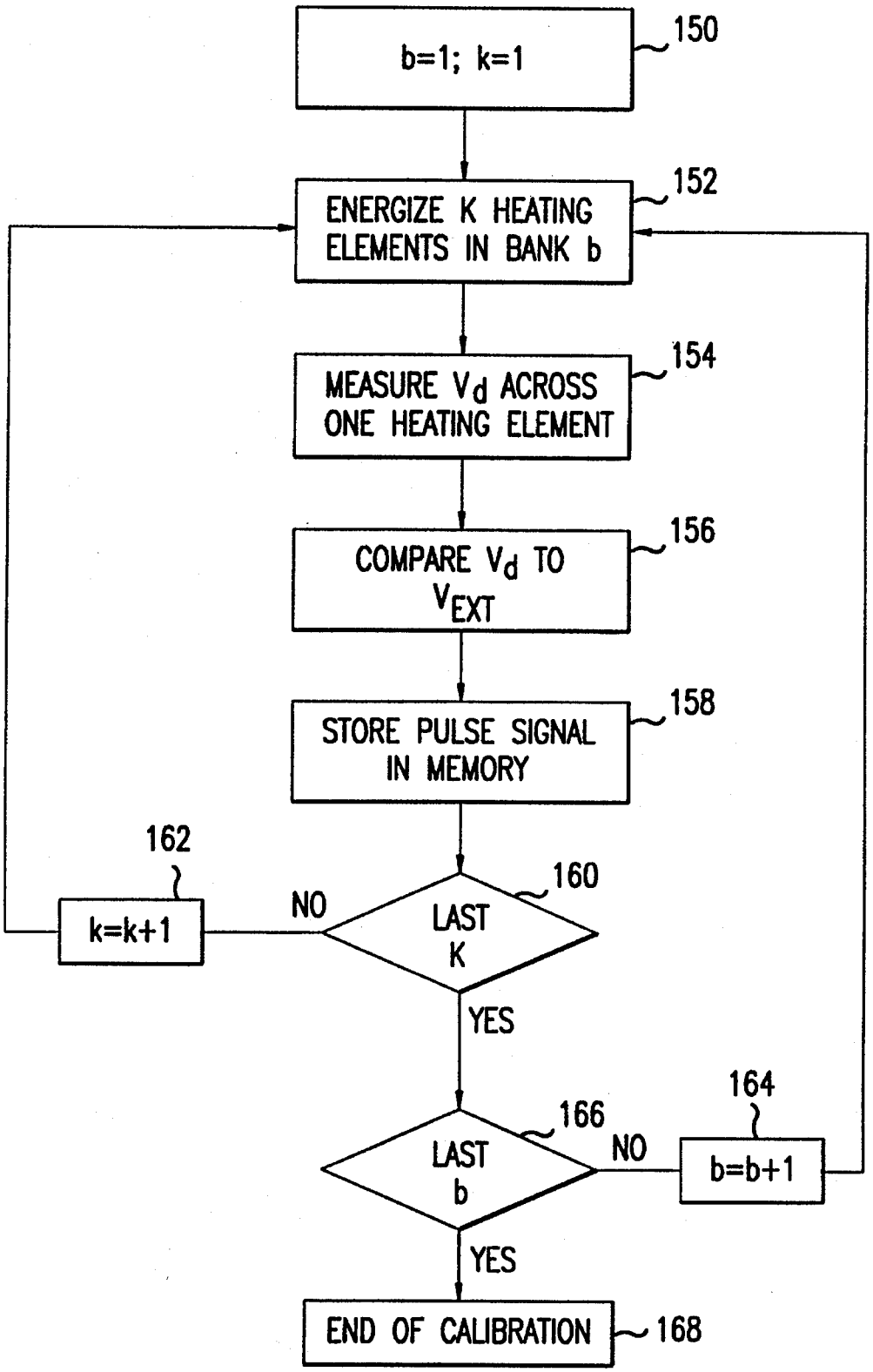
FIG. 10 is a flowchart showing a method for use with the fourth embodiment.

As shown in FIG. 10, in step 150 the variables b and k are initially set to 1 to represent the first bank and only one heating element of the first bank. Then in step 152, k heating elements in the bank b are actuated. Steps 154, 156 and 158 are similar to step is 132, 134 and 136 shown in FIG. 8. In decision step 160, the variable k is checked to determine if all of the heating elements in the respective bank b have been actuated in the previous step 152. If all of the heating elements have not been actuated, then step 162 increments the number of heating elements to be subsequently actuated in the next cycle. Then steps 152, 154, 156, 158 and 160 are repeated until all the heating elements have been actuated. At this point, the respective bank has been calibrated in a manner similar to that of the third embodiment.

When step 160 determines that all of the k heating elements have been actuated for a respective bank, step 166 determines whether all the banks have been calibrated. If step 166 determines that all the banks have not been calibrated, the cycle then continues by incrementing b by 1 and continuing with steps 152, 154, 156, 158 and 160 until all k heating elements of that bank have been actuated for calibration. After all k heating elements have been calibrated for all b banks, the calibration cycle ends in step 168.

Figure 11:
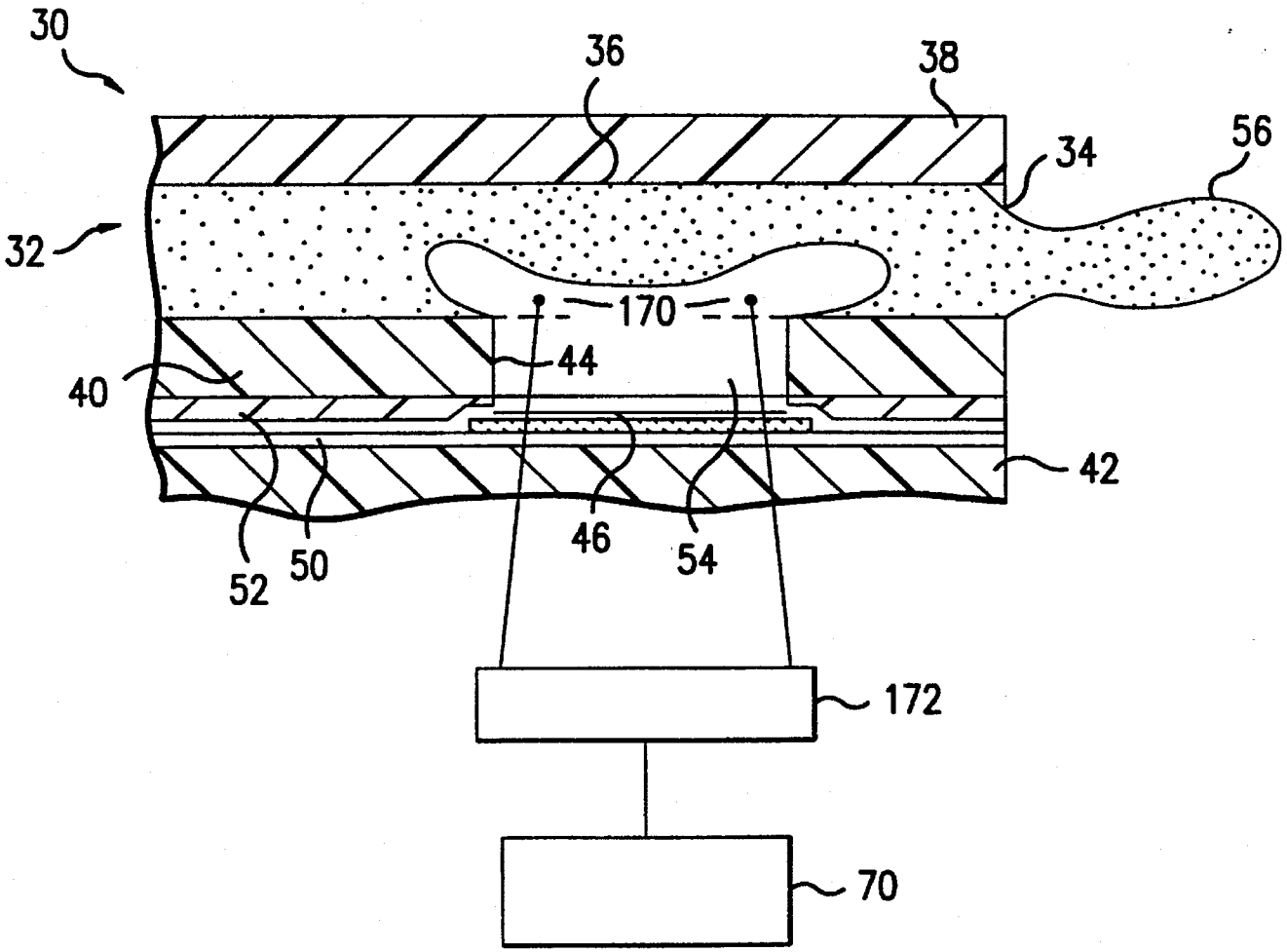
FIG. 11 is a view of a single ejector channel according to a fifth embodiment of the invention.

A fifth embodiment now will be described with reference to FIG. 11. The single ejector channel of FIG. 11 corresponds to the ejector channel of FIG. 2. However, in the fifth embodiment, a bubble sensor is placed in the channel 32 over the heating element 46. A bubble sensor used in a manner as described below provides adjustment: for non-electrical factors such as thermal conduction of heat from the heating element to the ink, film thickness over the heating element, heating element area variation and kogation. The bubble sensor generally comprises two electrodes 170 connected to a sensing device 172. The sensing device 172 is adapted to determine whether a bubble 54 has been created over the heating element 46. In particular, when no bubble 54 is present, then the recess 44 is completely filled with ink 36. Thus, a voltage drop can be determined due to the resistance of the ink 36 between electrodes 170. However, when a bubble 54 is created by energizing the heating element, generally no ink exists between the two electrodes 170. Thus, there is an extremely large voltage difference between the two electrodes 170. That is, there is an easily detectable difference in the voltage drop between electrodes 170 when ink (no bubble) is located over the heating element compared to when air or vapor (bubble) is located over the heating element. Accordingly, based on the voltage drop across the two electrodes 170, the sensing device 172 determines whether a bubble 54 exists.

In one alternative, the sensing device 172 is connected to a converging circuit 70 such as that shown in FIG. 4.

However, the input 64 to the multiplexor 73 will be a signal from the sensing device 152 indicating whether a bubble 54 has been formed. In likewise manner to that described above, the converging circuit 70 will iteratively determine the desired reference pulse signal to be applied to the driving transistor 58. It is appreciated that the converging circuit 70 will select the lowest correction code that generates a bubble 54.

In another alternative, the sensing device 172 is connected to a converging circuit such as that of FIG. 6. In this alternative, the adder 114 will sequentially step through the respective correction codes until the sensing device 172 determines that a bubble exists. When a bubble is determined to exist, the respective correction code is stored as the selected pulse signal in memory device 74.

Other embodiments showing a bubble sensor may similarly be used. For example, the two electrodes 170 do not have to be placed directly over the heating element 46. Rather, the two electrodes can be placed throughout the ejector channel such that it can be determined whether a bubble exists by measuring the electrical conduction of the ink.

In still another embodiment, ,a drop ejector detecting device is provided to determine whether a drop has been ejected from the printhead. As is known in the art, when a respective bubble bursts, a drop is ejected from the ejector channel. Thus, any well known drop ejector detecting device can appropriately determine when the drop is ejected and thus operate in a manner similar to the fifth embodiment.

Additionally, the fifth embodiment may be incorporated into the third embodiment to select a pulse signal depending on the number of activated heating elements in a single bank. The fifth embodiment may also be incorporated into the fourth embodiment to be used for each of the banks.

In the fifth embodiment, as in the first-fourth embodiments, a condition in the vicinity of the heating element is sensed in order to determine whether the pulses supplied to the heating element should be adjusted. In the first four embodiments, the condition is a voltage drop across the heating element. In the fifth embodiment, the condition is the existence of a bubble over the heating element, which can be sensed by measuring the voltage drop between two electrodes positioned over the heating element.

While the invention has been described in relation to preferred embodiments, many modifications and variations are apparent from the description of the invention, and all such modifications and variations are intended to be in the scope of the present invention as defined in the appended claims.

What is claimed is:

1. An ink jet apparatus for maintaining print quality by selecting stored pulse signals repeatedly applied to a heating element, the stored pulse signals causing the heating element to energize and produce ink droplets, the apparatus comprising:

storing means for storing the pulse signals;

pulsing means for applying pulse signals to the heating element;

detecting means for detecting a condition in a vicinity of the heating element when said pulse signals are applied to the heating element; and a code-generating and converging circuit that selects one of a plurality of predetermined correction codes based on the detected condition and a previous correction code and selects the stored pulse signals from the storing means based on the selected one of the plurality of predetermined correction codes.

2. The ink jet apparatus of claim 1, wherein the condition is an actual voltage drop across the heating element.

3. The ink jet apparatus of claim 2, wherein the circuit selects the stored pulse signals applied to the heating element by comparing the actual voltage drop across the heating element with a desired voltage drop.

4. The ink jet apparatus of claim 1, wherein the condition is a formation of a bubble over the heating element.

5. The ink jet apparatus of claim 4, wherein the detecting means comprises a bubble sensor for detecting the formation of the bubble over the heating element.

6. The ink jet apparatus of claim 5, wherein said bubble sensor measures a voltage drop between two electrodes located in the vicinity of said heating element.

7. The ink jet apparatus of claim 1, wherein the condition is the detection of an ink droplet.

8. The ink jet apparatus of claim 1, wherein said detecting means detects a voltage drop.

9. An ink jet apparatus for maintaining print quality by selecting stored pulse signals repeatedly applied to a heating element, the stored pulse signals causing the heating element to energize and produce ink droplets, the apparatus comprising:

a memory device storing the pulse signals;

measuring means for measuring an actual voltage drop across the heating element when the heating element is energized;

comparing means for comparing the actual voltage drop measured by the measuring means with a desired voltage drop and for generating a difference signal; and a code-generating and converging circuit that receives the difference signal and selects one of a plurality of predetermined corrections codes based on the difference signal and a previous correction code, the code-generating and converging circuit selecting the stored pulse signals applied to the heating element based on the selected one of the plurality of predetermined correction codes, the code-generating and converging circuit repeatedly selecting from among the plurality of different stored pulse signals until the actual voltage drop is within a predetermined range of the desired voltage drop.

10. An ink jet apparatus for maintaining print quality by selecting one of a plurality of different stored pulse signals, the selected one of the plurality of different stored pulse signals being applied to each of a predetermined number of heating elements to produce a corresponding number of ink droplets, the apparatus comprising:

a memory device having a plurality of memory locations, each memory location containing data representative of one of the different stored pulse signals;

an energizing circuit energizing each of the predetermined number of heating elements with a same one of the plurality of different stored pulse signals;

a measuring circuit measuring an actual voltage drop across one of the predetermined number of heating elements;

a comparing circuit comparing the actual voltage drop measured by the measuring circuit with a desired voltage drop and generating a difference signal based on a difference between the actual voltage drop and the desired voltage drop; and a code-generating and converging circuit receiving the difference signal and selecting one of a plurality of predetermined correction codes based on the difference signal and a previous correction code, the code-generating and converging circuit selecting a new pulse signal from the plurality of different stored pulse signals based on the selected correction code, the energizing circuit subsequently energizing each of the predetermined number of heating elements with the new pulse signal, the code-generating and converging circuit repeatedly selecting among the plurality of predetermined correction codes until the actual voltage drop is within a predetermined range of the desired voltage drop.

11. The ink jet apparatus of claim 10, wherein the correction code is a digital correction code comprising a plurality of bits.

12. The ink jet apparatus of claim 11, wherein the code generating and converging circuit comprises an adder for changing at least one of the bits of the previous correction code.

13. The ink jet apparatus of claim 10, wherein the code code generating and converging circuit initially determines an upper limit of the correction code and a lower limit of the correction code, the code generating and converging circuit generating the correction code by updating at least one of the upper limit and the lower limit each time the code generating and converging circuit receives the difference signal, the generated correction code updated to be within a range defined by the upper limit and the lower limit.

14. The ink jet apparatus of claim 13, wherein the generated correction code is an average of the upper limit and the lower limit.

15. The ink jet apparatus of claim 10, wherein the memory device includes a digital to analog convertor for converting the data of the memory location corresponding to the received correction code into the new pulse signal.

16. The ink jet apparatus of claim 10, further comprising a calibrating circuit varying the predetermined number of heating elements and determining the new pulse signal based on the predetermined number of heating elements.

17. The ink jet apparatus of claim 10, wherein the predetermined number of heating elements comprises at least one resistor.

18. The ink jet apparatus of claim 10, wherein the comparing circuit comprises a comparator.

19. The ink jet apparatus of claim 10, wherein the energizing circuit comprises a driving transistor.

20. The ink jet apparatus of claim 10, further comprising a memory device storing the new pulse signal in a memory location corresponding to the predetermined number of heating elements each time the actual voltage drop is within the predetermined range of the desired voltage drop.

21. A method for maintaining print quality by selecting stored pulse signals repeatedly applied to a heating element, the stored pulse signals causing the heating element to energize and produce ink droplets, the method comprising the steps of:

storing pulse signals in a memory device having a plurality of memory locations, each memory location containing data representative of one of the stored pulse signals;

energizing the heating element by applying one of the stored pulse signals to the heating element;

detecting a condition in a vicinity of the heating element when the heating element is energized;

selecting one of a plurality of predetermined correction codes based on the detected condition and a previous correction code; and energizing the heating element by applying the stored pulse signal to the heating element based on the selected one of the predetermined correction codes.

22. The method of claim 21, wherein the condition is an actual voltage drop across the heating element.

23. The method of claim 21, wherein the condition is a formation of a bubble over the heating element.

24. A method for maintaining print quality of an ink jet apparatus by selecting one of a plurality of different stored pulse signals to be applied to each of a predetermined number of heating elements, each of the predetermined number of heating elements producing at least one ink droplet when the selected one of the plurality of different stored pulse signals is applied to each of the predetermined number of heating elements, the method comprising the steps of:

(a) storing the plurality of different pulse signals in a memory device having a plurality of memory locations, each memory location containing data representative of one of the different stored pulse signals;

(b) energizing each of the predetermined number of heating elements at least once with an initial one of the plurality of different stored pulse signals;

(c) measuring an actual voltage drop across one of the predetermined number of heating elements;

(d) comparing the actual voltage drop with a desired voltage drop;

(e) generating a difference signal based on a difference between the actual voltage drop and the desired voltage drop;

(f) selecting a correction code from a plurality of predetermined correction codes based on the difference signal and a previous correction code;

(g) selecting a new pulse signal from the plurality of different stored pulse signals based on the selected correction code;

(h) energizing each of the predetermined number of heating elements at least once with the new pulse signal; and (i) repeating steps (c) to (h) until the actual voltage drop is within a predetermined range of the desired voltage drop.

25. The method of claim 24, wherein the selecting step further comprises retrieving the data in the memory location represented by the selected correction code.

26. The method of claim 24, wherein the retrieving step comprises converting the retrieved data into the new pulse signal.

27. The method of claim 24, wherein the correction code is a digital correction code comprising a plurality of bits.

28. The method of claim 24, wherein the generating step comprises changing at least one of the plurality of bits of the previous correction code.

29. The method of claim 24, wherein the selecting step comprises:

initially determining an upper limit of the correction code and a lower limit of the correction code; and computing the correction code by updating at least one of the upper limit and the lower limit each time the difference signal is received, the correction code being updated to be within a range defined by the upper limit and the lower limit.

30. The method of claim 29, wherein the selected correction code is an average of the upper limit and the lower limit.

31. The method of claim 24, further comprising storing the new pulse signal in a memory location corresponding to the predetermined number of heating elements each time the actual voltage drop is within the predetermined range of the desired voltage drop.

32. The method of claim 31, wherein the desired voltage drop is the actual voltage drop across a single heating element when only one heating element is energized.

33. The method of claim 32, further comprising the step of changing the predetermined number of heating elements and repeating steps (b) to (h).

* * * * *